US006071022A

United States Patent [19]

Verhoest et al.

[11] Patent Number: 6,071,022

[45] Date of Patent: Jun. 6, 2000

[54] SEALING ARRANGEMENT

[75] Inventors: Bart Verhoest, Niel; François Joos, Puurs; Dirk de Ruyter, Deurne, all of Belgium

[73] Assignee: Agfa-Gevaert, Mortsel, Belgium

[21] Appl. No.: 09/195,283

[22] Filed: Nov. 18, 1998

[30] Foreign Application Priority Data

Nov. 21, 1997 [EP] European Pat. Off. ..... 97203633

[51] Int. Cl.[7] ..... G03D 3/00

[52] U.S. Cl. ..... 396/617; 396/622; 396/636

[58] Field of Search ..... 396/579, 617, 396/620, 622, 624, 626, 630, 636, 637; 355/27

[56] References Cited

U.S. PATENT DOCUMENTS 4,122,475 10/1978 Roberts ..... 396/579
4,141,640 2/1979 Roberts ..... 396/579
5,313,242 5/1994 Devaney, Jr. et al. ..... 354/319
5,555,072 9/1996 Nomura et al. ..... 396/626

FOREIGN PATENT DOCUMENTS 0744658 11/1996 European Pat. Off. .

*Primary Examiner*—Alan A. Mathews
*Attorney, Agent, or Firm*—Baker Botts L.L.P.

[57] ABSTRACT

A machine part (24) is provided with a resilient seal (28) having an in-use condition in which the seal (28) protrudes beyond a sealing face (32) of the machine part (24). The seal (28) has an alternative condition in which it is accommodated in a cut-out portion (52) in the sealing face (32) of the machine part (24). The arrangement can be used in an apparatus comprising a number of machine parts, a first machine part (24) being provided with the resilient seal (28) which protrudes beyond a sealing face (32) of the first machine part (24) to seal the first machine part (24) to a second machine part (30). The arrangement enables such an apparatus to be dis-assembled with reduced risk of damaging the seal or tearing it from its mounting.

7 Claims, 4 Drawing Sheets

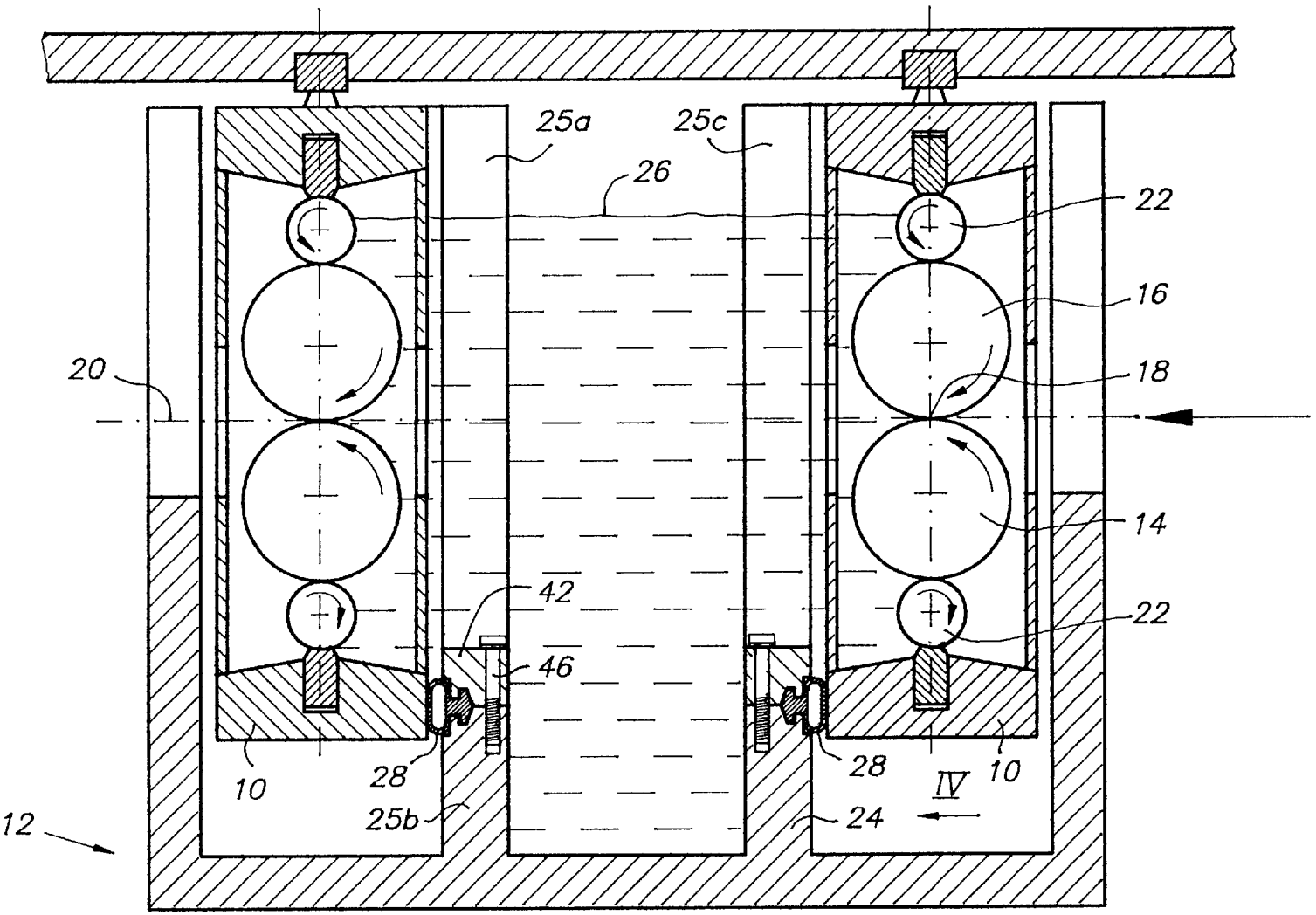
FIG. 1.1

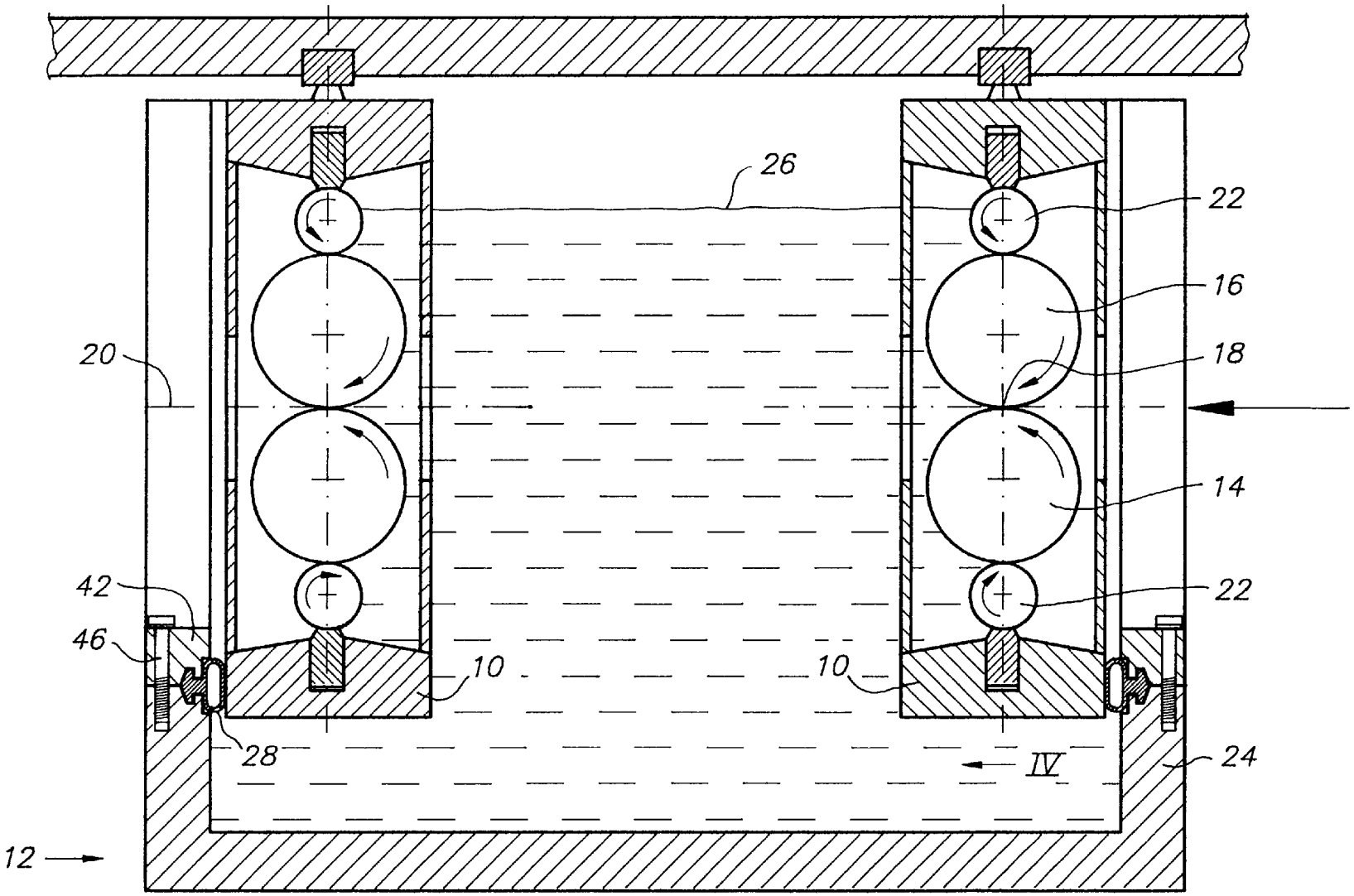
FIG. 1.2

SEALING ARRANGEMENT

DESCRIPTION

Field of the Invention

The present invention relates a sealing arrangement and in particular to the sealing of one machine part to another, such as for establishing a releasable fluid-tight seal between normally static components. The invention is of particular applicability to a photographic sheet material processing apparatus in which a number of removable processing modules are accommodated in a common housing.

BACKGROUND OF INVENTION

The sealing of machine parts to each other by means of a resilient seal is common practice. Usually a resilient seal is mounted on one machine part and makes sealing contact in use with the other machine part. Where the machine parts are stationary with respect to each other, the seal used is often referred to as a gasket or a non-dynamic seal. In some constructions, this gasket is accommodated in a gland or retaining groove formed in one machine part, but is of such a dimension as the protrude therefrom, so that when the machine parts are brought into contact with each other, the gasket makes sealing contact with both parts. In a similar manner, a dynamic sealing can be achieved between machine parts which are in movement relative to each other by the accommodation of a resilient seal in a groove of one part from which it protrudes to made sealing contact with the other part.

If it is desired to dis-assemble the apparatus in which these machine parts are located, it is sometimes necessary to move one part relative to the other in such a direction that a disruptive force is applied to the seal which may inadvertently tear the seal out of its mounting and/or which may damage the seal.

An example of an apparatus in which such a problem may arise is a photographic sheet material processing machine, particularly adapted for liquid processing, including a number of removable processing modules located within a common housing.

The housing, or member normally fixed thereto, is sealed to a frame of each processing module, the seal being so located as to prevent processing liquid in one processing module from entering an adjacent processing module. If it is desired to remove a processing module for maintenance purposes and then to replace it, or to substitute another processing module, the movement of the module out of, or in to, the housing can subject the seal to a force which may inadvertently tear the seal from its mounting and/or may damage the seal.

OBJECTS OF INVENTION

It is an object of the present invention to provide an arrangement for sealing one machine part to another, in which the risk of damage to the seal inadvertent tearing of the seal away from its mounting is reduced.

SUMMARY OF THE INVENTION

We have discovered that this object, and other useful advantages, can be achieved where the seal has a release condition in which it is accommodated in a cut-out portion formed in the machine part.

Thus, according to a first aspect of the invention there is provided a machine part provided with a resilient seal having an in-use condition in which the resilient seal protrudes beyond a sealing face of the machine part, characterised in that the resilient seal has an alternative condition in which it is accommodated in a cut-out portion in the sealing face of the machine part.

The resilient seal may comprise a hollow interior, the in-use condition being an inflated condition and the alternative condition being a deflated condition. The inflated condition is preferably a relaxed condition of the seal. The resilient seal is preferably so shaped as to avoid incomplete collapse upon application of a reduced pressure to the hollow interior thereof. For example, the resilient seal may be provided with a leakage groove to avoid such incomplete collapse.

The resilient seal may be formed of an elastomeric material, such as Neoprene (Trade Mark), PVC, EPDM, silicone or natural rubbers. The choice of material is determined by the environment to which the seal is to be subject. For example, where the seal is used to provide a liquid tight seal, the seal material should be resistant to attack by the liquid concerned. The optimum resilience of the seal material will be chosen according to the pressure difference which is to be expected across the seal.

In one embodiment, the resilient seal has a retaining portion clamped between two sections of the machine part. The cut-out portion in the sealing face of the machine part may advantageously be formed in adjacent regions of the two sections of the machine part.

In one embodiment, the resilient seal is elongate, and the cut-out portion in the sealing face of the machine part is a channel.

The sealing face of the machine part is preferably flat but the invention is also applicable the machine parts having curved sealing faces. For best sealing, the sealing face of the first machine part is parallel to the sealing face of the second machine part. In use, the sealing faces of the two machine parts are not normally in contact with each other, but are spaced by a small gap which is taken up by the seal protruding from the sealing face of the first machine part to make sealing contact with the sealing face of the second machine part.

According to a second aspect, the invention provides an apparatus comprising a number of machine parts, a first machine part being provided with a resilient seal having an in-use condition in which the resilient seal protrudes beyond a sealing face of the first machine part to seal the first machine part to a second machine part, characterised in that the resilient seal has an alternative condition in which it is accommodated in a cut-out portion in the sealing face of the first machine part to enable the first machine part to be dis-assembled from the second machine part.

In one embodiment, the first machine part is normally fixed within a housing of the apparatus and the second machine part is a removable machine part. Where the resilient seal comprises a hollow interior, the in-use condition being an inflated condition and the alternative condition being a deflated condition, the apparatus may include means for applying a reduced pressure to the hollow interior of the resilient seal to transform the resilient seal from the inflated condition to the deflated condition. In an alternative embodiment, the deflated condition may be the relaxed condition of the seal. In this embodiment, a pump may be provided to inflate the seal to transform it into its inflated in-use condition where it protrudes from the sealing face of the first machine part to make sealing contact with the second machine part.

The invention is particularly applicable to the sealing of static machine parts.

According to a third aspect, the invention provides a method of disassembling a first machine part sealed to a second machine part, in which the first machine part is provided with a resilient seal which comprises a hollow interior having an inflated condition in which the resilient seal protrudes beyond a sealing face of the first machine part to seal the first machine part to the second machine part, characterised by applying a reduced pressure to the hollow interior of the resilient seal to transform the resilient seal from the inflated condition to a deflated condition in which the resilient seal is accommodated in a cut-out portion in the sealing face of the first machine part to enable the first machine part to be dis-assembled from the second machine part.

Similarly, the invention provides a method of assembling a first machine part sealed to a second machine part, in which the first machine part is provided with a resilient seal which comprises a hollow interior, characterised by applying a reduced pressure to the hollow interior of the resilient seal to transform the resilient seal from an inflated condition to a deflated condition in which the resilient seal is accommodated in a cut-out portion in a sealing face of the first machine part to enable the first machine part and the second machine part to be moved into an assembled position relative to each other, and thereafter relieving the reduced pressure to transform the resilient seal from the deflated condition to an inflated condition in which the resilient seal protrudes beyond the sealing face of the first machine part to seal the first machine part to the second machine part.

The invention is particularly applicable to a photographic sheet material processing machine, particularly adapted for liquid processing, including a number of removable processing modules located within a common housing. The housing, or member normally fixed thereto, constitutes the first machine part of the invention. A frame of a processing module constitutes the second machine part. The resilient seal between the housing and the processing module frame may be so located as to prevent processing liquid in one processing module from entering an adjacent processing module. Release of the resilient seal by causing the resilient seal to be retracted into the cut-out portion, usually after processing liquid has been drained from the module, enables the module to be removed from the housing and replaced without risk of damage to the seal. With a processing module back in place, the resilient seal is re-established, by causing the resilient seal to revert to its in-use condition, e.g. its inflated condition in the case of a hollow seal.

DETAILED DESCRIPTION OF THE INVENTION

The invention will be described by the following illustrative embodiments with reference to the accompanying drawings without the intention to limit the invention thereto, and in which:

FIGS. 1.1 and 1.2 are a longitudinal cross-sections of part of a photographic sheet material processing apparatus according to two preferred embodiments of the invention;

Figure 2:
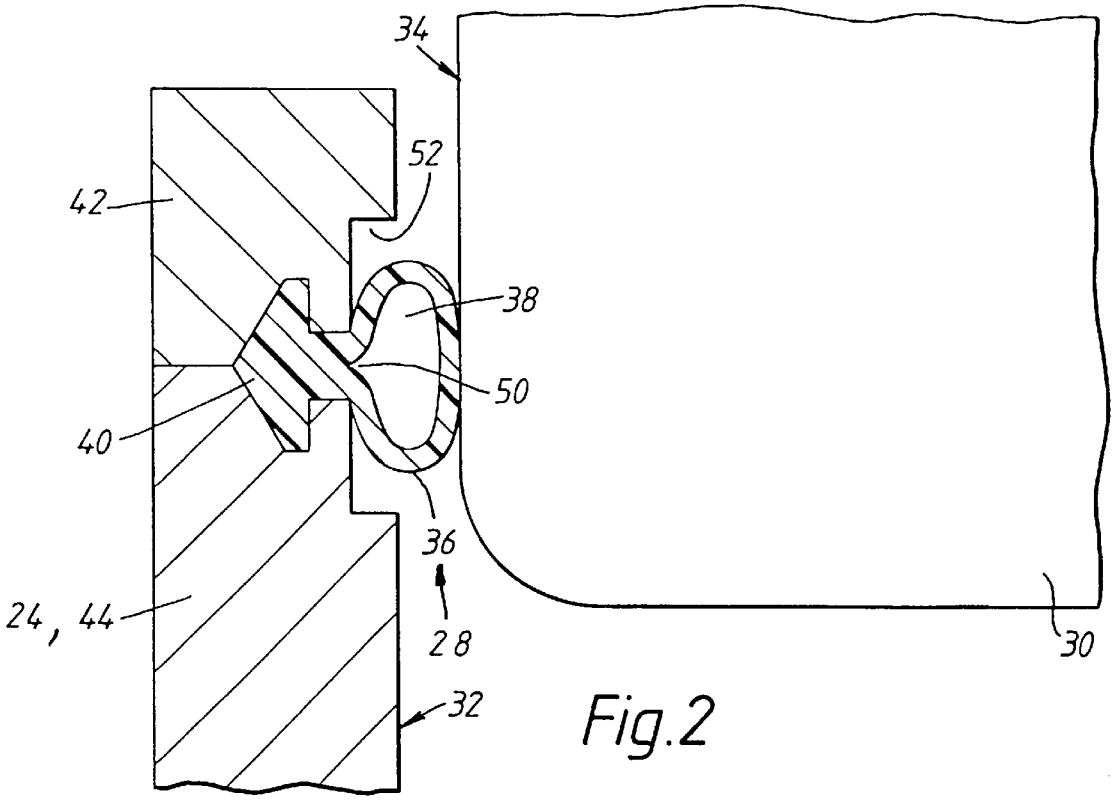
FIG. 2 is an enlargement of part of FIG. 1.
Figure 3:
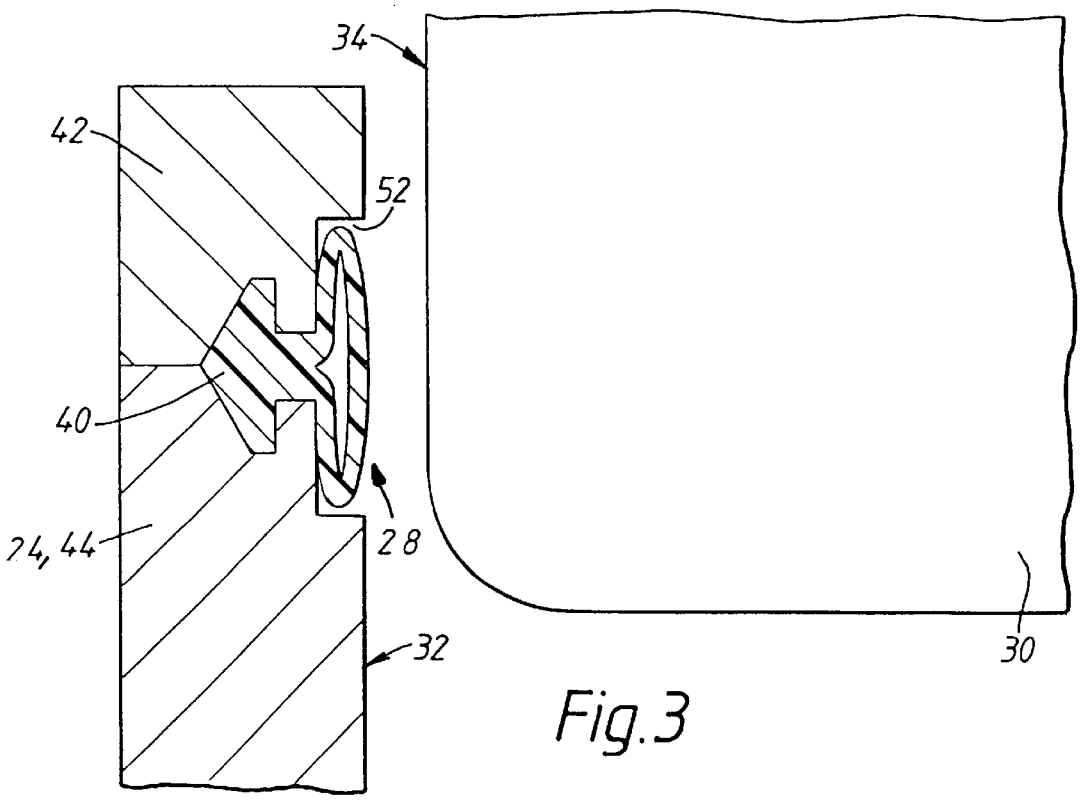
FIG. 3 is a view similar to FIG. 2, with the seal in its deflated condition.

As shown in the drawings, a photographic sheet material processing machine, adapted for liquid processing, includes the number of removable processing modules 10 located within the common housing 12. Each processing module 10 includes a pair of drive rollers 14, 16 in contact with each other to form a nip 18 through which a sheet material transport path 20 passes. The drive rollers 14, 16 typically comprise a rigid core with a covering of elastomeric material. Each drive roller is in contact with a stainless steel sealing roller 22 which serves to seal the drive roller to the frame 30 of the processing module 10. Each processing module 10 is located in the housing 12, between dividing walls 24. Each module contains processing liquid up to a level indicated by the line 26.

Depending upon the process to be carried out in the apparatus, one or more processing modules may be empty of processing liquid and one or more of the drive rollers may be replaced by other rotatable processing members such as freely rotating rollers and oppositely rotating brush rollers and wiping rollers.

A resilient seal 28 having an elongate configuration and is provided between the dividing wall 24 of the housing 12 and the processing module frame 30 and is so located as to prevent processing liquid in one processing module from entering an adjacent processing module. More specifically, the dividing wall 24 is generally U-shaped, with the seal 28 extending continuously from close to the top of one limb 25*a* of the "U", above the liquid level 26, down that limb 25*a* of the "U", across the base 25*b* of the "U", as can clearly be seen in FIG. 1, and up the other limb 25*c* of the "U" to a point above the liquid level 26, as can be more clearly seen in FIG. 4.

The seal 28 is located in a flat sealing face 32 of the housing dividing wall 24, the sealing face 32 being parallel to a sealing face 34 of the processing module frame 10.

The seal 28 is typically formed of a silicone elastomeric material. In cross-section, the seal 28 comprises a main portion 36 having a hollow interior 38 and a retaining portion 40 which is clamped between two sections 42, 44 of the housing dividing wall 24. The two sections of the wall 24 are connected together, for example by bolts 46.

In-use, as shown in FIG. 2, the seal 28 is in an inflated condition, which is its relaxed condition. In this condition, the main portion 36 of the seal 28 protrudes beyond a sealing face 32 of the housing dividing wall 24, into sealing contact with the sealing face 34 of the processing module frame 30.

Figure 4:
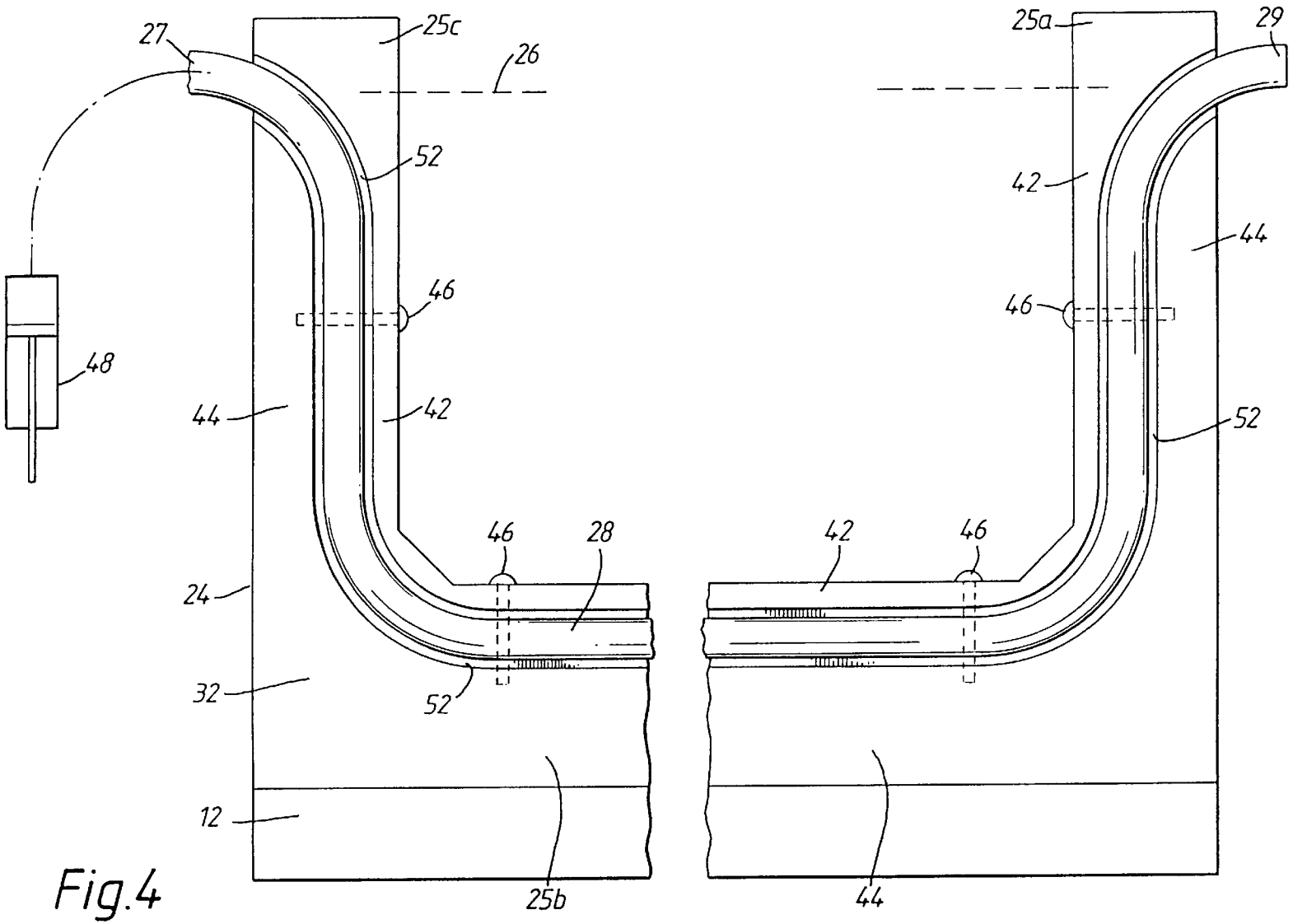
FIG. 4 is a partly schematic view of a dividing wall of the housing of the apparatus shown in FIGS. 1.1 and 1.2, viewed in the direction of the arrow IV in the Figure.

As shown in FIG. 4, one end 27 of the seal 28 is connected to a pump 48 for applying a reduced pressure to the hollow interior 38 of the seal 28 to transform the seal 28 from the inflated condition to a deflated condition. The other end 29 of the seal 28 is closed. A common pump may be provided for the seals of all processing modules in the apparatus. The pump may be manually or mechanically operated. A leakage groove 50 formed adjacent the hollow interior 38 of the seal 28, avoids incomplete collapse of the seal upon the application of the reduced pressure to the hollow interior 38.

The deflated condition of the seal represents a release condition in which the seal 28 is fully accommodated in a channel 52 in the sealing face 32 of the housing dividing wall 24. The channel 52 in the sealing face 32 of the housing dividing wall 24 is formed in adjacent regions of the two sections 42, 44 of the housing dividing wall 24.

Release of the seal 28 by causing it to be retracted into the channel 52, usually after processing liquid has been drained from the module, enables the processing module 10 to be removed from the housing 12 and replaced without risk of damage to the seal 28. With the same or a different processing module back in place, the seal 28 is re-established by releasing the reduced pressure which had been applied to the hollow interior 38. This causes the seal 28 to revert to its in-use relatively inflated condition where it comes into sealing contact with the processing module frame 30.

REFERENCE NUMBER LIST

| | |
|---|---|
| processing modules 10 | other end 29 |
| common housing 12 | processing module frame 30 |
| drive rollers 14, 16 | flat sealing face 32 |
| nip 18 | sealing face 34 |
| path 20 | main portion 36 |
| sealing roller 22 | hollow interior 38 |
| dividing walls 24 | a retaining portion 40 |
| one limb 25a | two sections 42, 44 |
| base 25b | bolts 46 |
| other limb 25c | pump 48 |
| line 26 | leakage groove 50 |
| one end 27 | a channel 52 |
| seal 28 | |

What is claimed is:

1. A machine part provided with an inflatable resilient seal having an in-use condition in which the resilient seal protrudes beyond a sealing face of the machine part, characterized in that the resilient seal has an alternative condition in which it is accommodated in a cut-out portion in the sealing face of the machine part, wherein said resilient seal comprises a hollow interior and wherein in said in-use condition the resilient seal is in an inflated condition and in said alternative condition the resilient seal is in a deflated condition and wherein said resilient seal is held within said machine part by non-adhesive retaining means.

2. A machine part according to claim 1, wherein the resilient seal is elongate, and the cut-out portion in the sealing face of the machine part is a channel.

3. A machine part according to claim 1, wherein the sealing face of the machine part is flat.

4. An apparatus comprising a plurality of machine parts, including a first machine part provided with an inflatable resilient seal having an in-use condition in which the resilient seal protrudes beyond a sealing face of the first machine part to seal the first machine part to a second machine part, characterized in that the resilient seal has an alternative condition in which it is accommodated in a cut-out portion in the sealing face of the first machine part to enable the first machine part to be dis-assembled from the second machine part, wherein said resilient seal comprises a hollow interior and wherein in said in-use condition the resilient seal is in an inflated condition and in said alternative condition the resilient seal is in a deflated condition and wherein said resilient seal is held within said first machine part by non-adhesive retaining means.

5. An apparatus according to claim 4, wherein the first machine part is normally fixed within a housing of the apparatus and the second machine part is a removable machine part.

6. A method of dis-assembling a first machine part sealed to a second machine part, in which the first machine part is provided with an inflatable resilient seal which comprises a hollow interior having an inflated condition in which the resilient seal protrudes beyond a sealing face of the first machine part to seal the first machine part to the second machine part, said resilient seal is being held within said first machine part by non-adhesive retaining means characterized by applying a reduced pressure to the hollow interior of the resilient seal to transform the resilient seal from the inflated condition to a deflated condition in which the resilient seal is accommodated in a cut-out portion in the sealing face of the first machine part to enable the first machine part to be dis-assembled from the second machine part.

7. A method of assembling a first machine part sealed to a second machine part, in which the first machine part is provided with an inflatable resilient seal which comprises a hollow interior, said resilient seal is being held within said first machine part by non-adhesive retaining means characterized by applying a reduced pressure to the hollow interior of the resilient seal to transform the resilient seal from an inflated condition to a deflated condition in which the resilient seal is accommodated in a cut-out portion in a sealing face of the first machine part to enable the first machine part and the second machine part to be moved into an assembled position relative to each other, and thereafter relieving said reduced pressure to transform the resilient seal from the deflated condition to an inflated condition in which the resilient seal protrudes beyond the sealing face of the first machine part to seal the first machine part to the second machine part.

* * * * *